US006972742B2

(12) United States Patent
Dennehey

(10) Patent No.: US 6,972,742 B2
(45) **Date of Patent: *Dec. 6, 2005**

(54) METHOD OF CURRENT BALANCING IN VISUAL DISPLAY DEVICES

(75) Inventor: Patrick N. Dennehey, Lake Forest, CA (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 362 days.

This patent is subject to a terminal disclaimer.

(21) Appl. No.: 10/141,325

(22) Filed: May 7, 2002

(65) Prior Publication Data

US 2002/0167506 A1 Nov. 14, 2002

Related U.S. Application Data

(60) Provisional application No. 60/290,100, filed on May 9, 2001.

(51) Int. Cl.[7] ..... G09G 3/30

(52) U.S. Cl. ..... 345/76; 345/82; 345/212; 315/169.3

(58) Field of Search ..... 345/76–83

(56) References Cited

U.S. PATENT DOCUMENTS

| | | | | |
|---|---|---|---|---|
| 5,668,569 | A | 9/1997 | Greene et al. | 345/103 |
| 5,903,246 | A | 5/1999 | Dingwall | |
| 6,020,864 | A | 2/2000 | Bancal | 345/74.1 |
| 6,177,767 | B1 | 1/2001 | Asai et al. | 315/169.1 |
| 6,222,357 | B1 * | 4/2001 | Sakuragi | 323/315 |
| 6,229,508 | B1 | 5/2001 | Kane | 345/82 |
| 6,291,942 | B1 | 9/2001 | Odagiri et al. | 315/169.3 |
| 6,326,938 | B1 | 12/2001 | Ishida et al. | 345/63 |
| 6,332,661 | B1 | 12/2001 | Yamaguchi | |
| 6,373,454 | B1 | 4/2002 | Knapp et al. | |
| 6,433,488 | B1 * | 8/2002 | Bu | 315/169.3 |
| 6,498,592 | B1 | 12/2002 | Matthies | 345/1.1 |
| 6,501,449 | B1 * | 12/2002 | Huang | 345/82 |
| 6,518,962 | B2 * | 2/2003 | Kimura et al. | 345/211 |
| 2001/0024186 | A1 | 9/2001 | Kane et al. | 345/76 |

FOREIGN PATENT DOCUMENTS

| | | |
|---|---|---|
| JP | 2000-293245 | 10/2000 |
| WO | WO 99/65011 | 12/1999 |

OTHER PUBLICATIONS

International Search Report dated Oct. 22, 2003 for International Application No. PCT/US02/14687.

* cited by examiner

*Primary Examiner*—Alexander Eisen
(74) *Attorney, Agent, or Firm*—Knobbe, Martens, Olson & Bear, LLP

(57) ABSTRACT

A method of providing balanced currents at locations in devices requiring accurate, matched and repeatable current sources, for example visual display devices having arrays of light-emitting sources. In one embodiment, the method provides closely balanced currents flowing through column drivers located at or near end regions of a display area portion of a visual display device. An additional embodiment of the method allows for balancing currents at adjacent columns or regions throughout the display areas of a visual display device.

12 Claims, 3 Drawing Sheets

METHOD OF CURRENT BALANCING IN VISUAL DISPLAY DEVICES

RELATED APPLICATIONS

This application claims the benefit under 35 U.S.C. § 119(e) of, and hereby incorporates by reference in its entirety, U.S. Provisional Application No. 60/290,100, filed May 9,2001 and titled "METHOD AND SYSTEM FOR CURRENT BALANCING IN VISUAL DISPLAY DEVICES".

This application is related to, and hereby incorporates by reference in their entirety, the following:

U.S. application Ser. No. 10/141,650, filed on even date herewith and titled "SYSTEM FOR CURRENT BALANCING IN VISUAL DISPLAY DEVICES";

U.S. application Ser. No. 09/904,960, filed Jul. 13, 2001 and titled "BRIGHTNESS CONTROL OF DISPLAYS USING EXPONENTIAL CURRENT SOURCE";

U.S. application Ser. No. 10/141,659, filed on even date herewith and titled "SYSTEM FOR CURRENT MATCHING IN INTEGRATED CIRCUITS";

U.S. application Ser. No. 10/141,326, filed on even date herewith and titled "METHOD OF CURRENT MATCHING IN INTEGRATED CIRCUITS";

U.S. application Ser. No. 09/852,060, filed May 9, 2001 and titled "MATRIX ELEMENT VOLTAGE SENSING FOR PRECHARGE";

U.S. application Ser. No. 10/141,454, filed on even date herewith and titled "METHOD OF SENSING VOLTAGE FOR PRECHARGE";

U.S. application Ser. No. 10/141,648, filed on even date herewith and titled "APPARATUS FOR PERIODIC ELEMENT VOLTAGE SENSING TO CONTROL PRECHARGE";

U.S. application Ser. No. 10/141,318, filed on even date herewith and titled "METHOD FOR PERIODIC ELEMENT VOLTAGE SENSING TO CONTROL PRECHARGE";

U.S. patent application Ser. No. 10/029563, filed Dec. 20, 2001, entitled "METHOD OF PROVIDING PULSE AMPLITUDE MODULATION FOR OLED DISPLAY DRIVERS"; and U.S. patent application Ser. No. 10/029605, filed Dec. 20, 2001, entitled "SYSTEM FOR PROVIDING PULSE AMPLITUDE MODULATION FOR OLED DISPLAY DRIVERS".

BACKGROUND OF THE INVENTION

1. Field of the Invention

The invention relates to the field of current-driven electronic devices such as visual display devices. More particularly, the invention relates to current balancing circuits for devices requiring accurate, matched and repeatable current drivers, for example visual displays having arrays of light-emitting sources.

2. Description of the Related Technology

Visual display devices are widely used to present visual information and cues to users, operators or viewers of various systems. Not infrequently, visual displays use arrays of light-emitting sources, often consisting of diodes organized in a columnar configuration. These arrays are often arranged such that columns of light-emitting sources are driven by individual current sources. These light-emitting sources are also commonly connected to externally switched rows to complete the electrical circuit, thereby allowing proper illumination of the visual display.

As visual displays typically consist of a multitude of these arrays of light-emitting sources, several (for example 3–4) integrated electronic circuits are required to connect all the columns. Physically, these integrated circuits are necessarily very long and narrow to accommodate the large number of connections and to match the linear connection arrangement of the array. This wide physical separation of circuit components permits temperature variations between sensitive elements, often resulting in performance variations among these elements. In addition, variations in the manufactured characteristics of electronic components also often result in unpredictable and varying performance. Such performance variations often cause poor matching of the current sources at the ends of these individual integrated circuits. When the currents at the ends of an individual column driver circuit are not well matched, the result is a variation in brightness at these end columns that make it difficult to match them to the adjacent columns driven by separate driver circuits. This abrupt discontinuity in brightness is often noticeable to the users of the visual display devices.

Typically, manufacturers in the industry of visual display devices attempt to match all adjacent columns in the same integrated circuit. As the electronic components for adjacent columns are typically located in close proximity on the electronic circuit layout, they tend to be inherently closely matched. In addition, as the eye is relatively insensitive to slowly changing spatial brightness, it is not particularly essential that all adjacent columns of light-emitting sources within an individual integrated circuit be absolutely uniform provided that the differences are not abrupt.

However, when there is a difference in the current sources, a discontinuity often results between columns. As the human eye is very discerning of differences in brightness at sharp edges of light patterns, this results in a noticeable discontinuity in the smoothness of the visual display, resulting in a perceptible degradation in the quality of the display. Accordingly, there is a need in the technology for a column driver circuit in which current sources are closely matched.

SUMMARY OF CERTAIN INVENTIVE ASPECTS

In one embodiment, the invention provides a method of balancing currents in a display device having at least one display area which includes first and second end regions. The method comprises generating a first current from a first driver circuit located substantially in the first end region of the display area. The method further comprises generating a second current from a second driver circuit located substantially in the second end region of the display area. The method further comprises substantially matching the first current with the second current.

In another embodiment, the invention provides a method of manufacturing a circuit for balancing currents in a display device having at least one display area which includes first and second end regions. The method comprises the step of assembling a first driver circuit substantially in the first end region of the display area, the first driver circuit being configured to generate a first current. The method farther comprises the step of assembling a second driver circuit substantially in the second end region of the display area, the second driver circuit being configured to generate a second current. The method further comprises the step of electrically connecting a balancing circuit to the first and second driver circuits to substantially match the first current with the second current.

BRIEF DESCRIPTION OF THE DRAWINGS

The above and other aspects, features and advantages of the invention will be better understood by referring to the following detailed description, which should be read in conjunction with the accompanying drawings. These drawings and the associated description are provided to illustrate certain embodiments of the invention, and not to limit the scope of the invention.

DETAILED DESCRIPTION OF THE CERTAIN EMBODIMENTS

The following detailed description is directed to certain specific embodiments of the invention. However, the invention can be embodied in a multitude of different ways as defined and covered by the claims. The scope of the invention is to be determined with reference to the appended claims. In this description, reference is made to the drawings wherein like parts are designated with like numerals throughout.

To overcome the above-mentioned visual display limitations, the invention provides a current balancing system that closely matches the current sources at the end columns or regions of arrays driven by individual driver or integrated circuits. This results in a noticeable improvement in the quality of visual displays implementing the apparatus or method of the invention.

As used herein, the term "balancing" does not merely refer to an exact matching of currents through the columns of a driver circuit, but refers also to an approximate matching of currents to a degree sufficient to improve the image quality of a visual display device. Additionally, the terms "balance" and "match" are herein used interchangeably. Moreover, the term "end regions" refers to left and right-end regions in which one or more end column driver circuits are located. For example, up to five end column driver circuits may be located in a left or right end region. In view of the following description, it will be apparent to those of ordinary skill in the technology to vary the number of end column driver circuits to less or greater than five and still achieve the objects of the invention.

Figure 1:
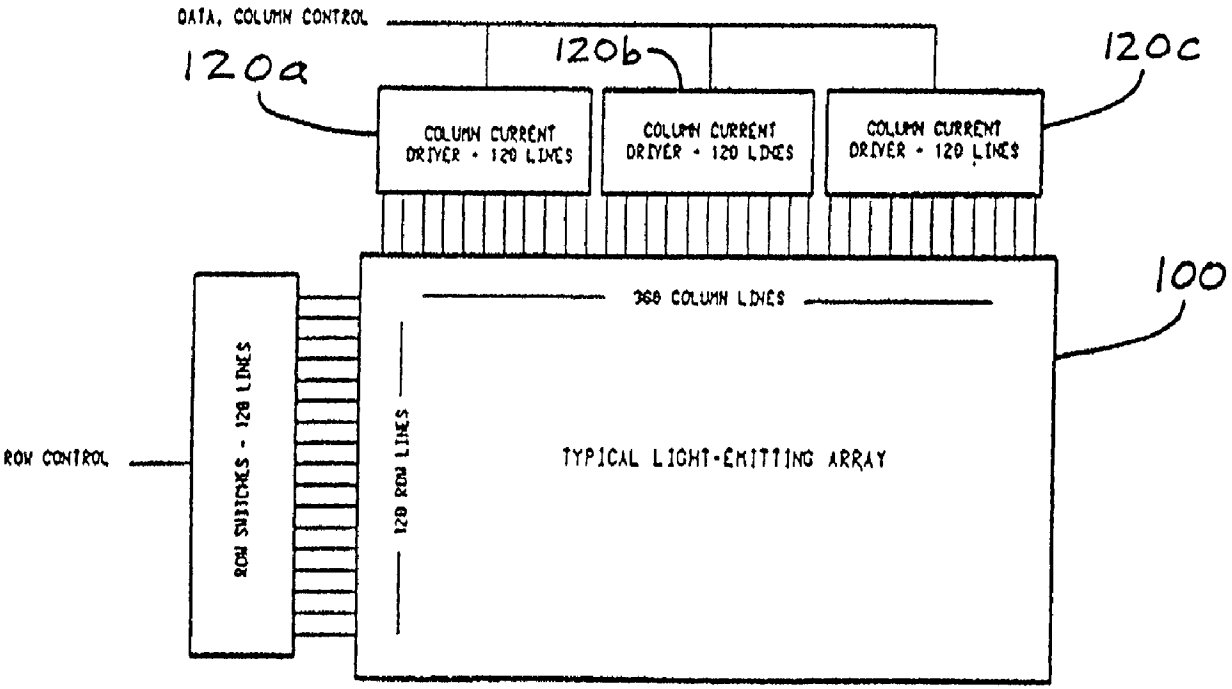
FIG. 1 is a block diagram of a visual display device with multiple display portion areas driven by individual driver circuits.

FIG. 1 is a diagram of a visual display device 100 with multiple display portion areas driven by individual driver circuits. In this embodiment, the visual display device 100 comprises three display areas. Although the visual display device 100 typically comprises multiple display areas, often three to four, other numbers of display areas are also within the scope of the present invention. Each display area is typically driven by separate group driver circuits 120*a*, 120*b* and 120*c* (hereinafter collectively referred to as "120"). Each of the group driver circuits 120 typically comprises at least a current source (not shown in this figure) that generates a current to drive one of the display areas. These display areas typically do not represent a physical separation or segmentation of the display device, but instead represent logical areas of the display distinct only in respect to being driven by separate group driver circuits 120. Each of the display areas typically comprises arrays of light-emitting sources, often diodes, arranged in columns. Such light-emitting diodes ("LEDs") generate light to illuminate picture elements ("pixels"), which collectively form a desired image on a screen of the display device 100. Each of the display areas typically comprises a plurality of pixels arranged in an array of columns and rows. Other configurations of display devices 100 are also within the scope of the present invention.

Figure 2:
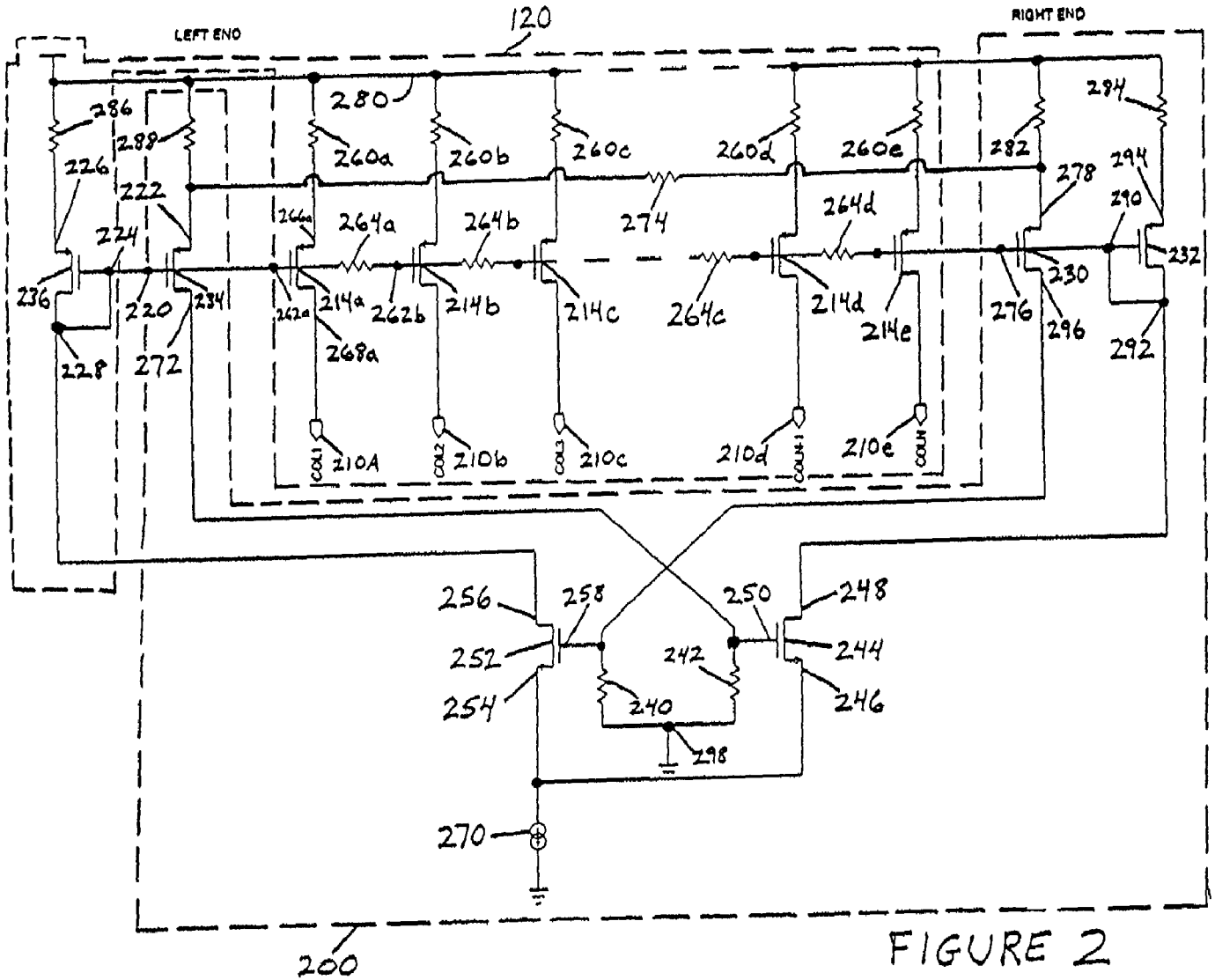
FIG. 2 is a schematic diagram of a balancing circuit in operation with a display area in accordance with one embodiment of the invention.

FIG. 2 is a schematic diagram of a balancing circuit 200 in operation with the display area in accordance with one embodiment of the invention. The balancing circuit 200 balances currents in the group driver circuit 120. The group driver circuit 120 may drive a plurality of columns of light-emitting sources, typically ranging in number up to approximately three hundred eighty columns. However, one of ordinary skill in the technology will realize that embodiments in which larger numbers of columns are driven by group driver circuits 120 are within the scope of the invention.

Each of the group driver circuits 120 comprises a plurality of individual driver circuits having current source column transistors 214*a*, 214*b*, 214*c*, 214*d* and 214*e* (hereinafter collectively referred to as "214"). The number of column transistors 214 is typically the same as the number of columns "N" for each of the group driver circuits 120, as depicted by the designation "N" both in FIG. 2 and throughout this application. References to individual columns in this application are made by appending the three letter prefix "COL" with a suffix consisting of the sequential number of the column, starting with "1" at the lefthand side in FIG. 2. For example, the left-most column is referred to as "COL1" 210*a* and the right-most column as "COLN" 210*e*. The number of columns "N", which may vary for different display devices 100 and group driver circuits 120, is not consequential for the present invention.

In this embodiment, each of the transistors 214 comprises a gate terminal (e.g., a gate terminal 262*a* of the transistor 214*a*), a source terminal (e.g., a source terminal 266*a* of the transistor 214*a*) and a drain terminal (e.g., a drain terminal 268*a* of the transistor 214*a*). To enhance the clarity of FIG. 2, only the terminals of the left-most column transistor 214*a* are labeled. However, each of the transistors 214 depicted in the embodiment of FIG. 2 correspondingly comprises a gate, drain and source terminal.

Each of the group driver circuits 120 further comprises a plurality of resistors 264*a*, 264*b*, 264*c* and 264*d* (hereinafter collectively referred to as "264"), each being connected between two gate terminals of two adjacent column transistors 214. As an example, the resistor 264*a* is connected between the gate terminal 262*a* of column transistor 214*a* and the gate terminal 262*b* of the column transistor 214*b*. The drain terminals of the column transistors 214 are connected to light-emitting source array columns 210*a*, 210*b*, 210*c*, 210*d* and 210*e* (hereinafter collectively referred to as "210"), respectively. The source terminals of the column transistors 214 are connected to lower ends (in relation to FIG. 2) of a plurality of resistors 260*a*, 260*b*, 260*c*, 260*d* and 260*e* (hereinafter collectively referred to as "260"), respectively. Each of the resistors 260 is connected at an upper end to a common electrical connection 280.

In this embodiment, each of the group driver circuits 120 further comprises a current mirror diode-connected transistor 236 having a gate terminal 224 that is connected to the gate terminal 220 of source transistor 234. The mirror transistor 236 further includes a drain terminal 228 that is connected to the gate terminal 224 of the same transistor 236. The source terminal 226 of the mirror transistor 236 is connected to a lower end (as in relation to FIG. 2) of a resistor 286. The resistor 286 includes an upper end that is connected to the common electrical connection 280.

As shown in the embodiment of FIG. 2, the balancing circuit 200 comprises a current source transistor 234 having a gate terminal 220 that is connected to the gate terminal 262*a* of column transistor 214*a*. The source transistor 234 includes a source terminal 222 that is connected to a lower end of a resistor 288. An upper end of resistor 288 is connected to the common electrical connection 280.

The balancing circuit 200 further comprises a current source transistor 230 having a gate terminal 276 that is connected to the gate terminal of column transistor 214*e*. The source transistor 230 includes a source terminal 278 that is connected to a lower end (as in relation to FIG. 2) of a resistor 282. An upper end of the resistor 282 is connected to the common electrical connection 280. The balancing circuit 200 further comprises a current mirror diode-connected transistor 232 having a gate terminal 290 that is connected to the gate terminal 276 of source transistor 230. The transistor 232 includes a gate terminal 290 that is additionally connected to a drain terminal 292 of the same mirror transistor 232. The mirror transistor 232 further includes a source terminal 294 that is connected to a lower end of a resistor 284. The resistor 284 includes an upper end that is connected to the common electrical connection 280.

The balancing circuit 200 further comprises two closely matched and closely spaced resistors 240 and 242, each having an upper end (in relation to FIG. 2) connected to the drain terminals 296 and 272 of the source transistors 230 and 234, respectively. In one embodiment, the two resistors 240 and 242 are closely matched if the tolerance variance between them allows the precision of current matching desired to be achieved. In another embodiment, for example, to achieve current matching at the output source of 0.1%, closely matched may mean each component has a matching tolerance of 0.02% in the case where the circuit includes 5 components. Each of the resistors 240 and 242 include a lower end that is connected to a common electrical ground 298.

The balancing circuit 200 further comprises a transistor 244 having a gate terminal 250 that is connected to the matched resistor 242 at the connection point to the source transistor 234 as described above. The transistor 244 includes a drain terminal 248 that is connected to the drain terminal 292 of the mirror transistor 232. The balancing circuit 200 further comprises a transistor 252 that is closely matched and closely spaced with transistor 244, and having a gate terminal 258 that is connected to the matched resistor 240 at the connection point to the source transistor 230 as described above. The transistor 252 includes a drain terminal 256 that is connected to the drain terminal 228 of the mirror transistor 236. The transistor 252 includes a source terminal 254 that is connected to a source terminal 246 of the transistor 244.

The balancing circuit 200 further comprises a reference current source 270 that is connected in series with the source terminal 254 of the matched transistor 252 to electrical ground. The current source 270 may be variable or fixed in value. The reference current source 270 sets the original current magnitude to be accurately matched by the balancing circuit 200. The magnitude of the reference current affects the value and size of the electrical components comprising the balancing circuit 200.

The following paragraphs provide a description of the operation of the balancing circuit 200. As described above, each of the resistors 260, 282, 284, 286, 288 are connected to the common electrical connection 280, yielding a common voltage potential at the connection 280. The common voltage potential at the common connection 280 and the connection of transistors 230, 232, 234, 236 to the group driver circuit 120, as described above, results in a closely matching current flowing through each of the column transistors 214.

However, temperature- or manufacturing-related variations in the characteristics of the column transistors 214 and resistors 260 from end-to-end may be present, thereby causing unbalanced currents to flow in the source transistors 230, 234. The matched resistors 240, 242 compensate for this current imbalance so that the currents flowing through the matched transistors 244, 252 are adjusted to minimize or eliminate the current imbalance. In one embodiment, the source transistors 230 and 234 provide currents to flow through the resistors 240 and 242, respectively, to the common electrical ground 298. If the currents flowing from the source transistors 230 and 234 are not initially matched, the resistors 240 and 242 produce a discrepancy in gate voltages at the gate terminals 258 and 250 of the transistors 252 and 244. Because of the closely spaced and closely matched characteristics of the resistors 240 and 242, the discrepancy in the gate voltages is preserved. However, since the source terminals 246 and 254 are tied to a common electrical potential (i.e., voltage level), the gate voltages are forced to match, thereby yielding matched currents flowing from the transistors 230 and 234.

As shown in the embodiment of FIG. 2, the left-most column transistor 214*a* is typically physically located near the left-most source transistor 234. Similarly, the right-most column transistor 214*e* is typically physically located near the right-most source transistor 230. Therefore, differences in their currents are minimized due to their close physical proximity on the integrated circuit. Since the gate terminals 262 of the column transistors 214 connect together through resistors 264, any difference in the gate voltage between the column transistors 214*a* and 214*e* is uniformly distributed across the group driver circuit 120. In the embodiment of FIG. 2, a resistor 274 is added to increase the sensitivity of the detection of a current imbalance between these end transistors 214*a* and 214*e*.

In one embodiment, the transistors referred to herein may be of the class of transistors well known in the technology as Field-Effect Transistors ("FET"). FET's are comprised of three terminals, referred to in the description and depicted in the figures as the gate terminal, source terminal and drain terminal. Additionally, the terminals are also referred to by the corresponding shorthand notation of gate, source and drain. In another embodiment, the transistors may be of the class of transistors well known in the technology as Bipolar Junction Transistors (BJT), or other electronic devices. BJT's are comprised of 3 terminals, referred to as the base terminal, emitter terminal and collector terminal. The three terminals are also referred to by the corresponding shorthand notation of base, emitter and collector. However, other classes of transistors are also within the scope of the present invention.

In one embodiment, the value of the matched resistors 240, 242 is 10K ohms, but other values may operate at least as well. In another embodiment, the value of the series resistors 264 is 1K Ohms, but other values may operate at least as well. In a further embodiment, the value of the resistors 260, 282, 284, 286, 288 is 1K Ohms, but other values may operate at least as well. In another embodiment, the value of the series resistors 274 is 10K Ohms, but other values may operate at least as well. While any specific resistor values are not required by the present invention, a nominal range may be within a decade greater or smaller than the resistor values in the embodiment described in this paragraph. Within a decade means, for example, for a 1K Ohm resistor, a nominal range may be from 100 Ohms to 10K Ohms.

Figure 3:
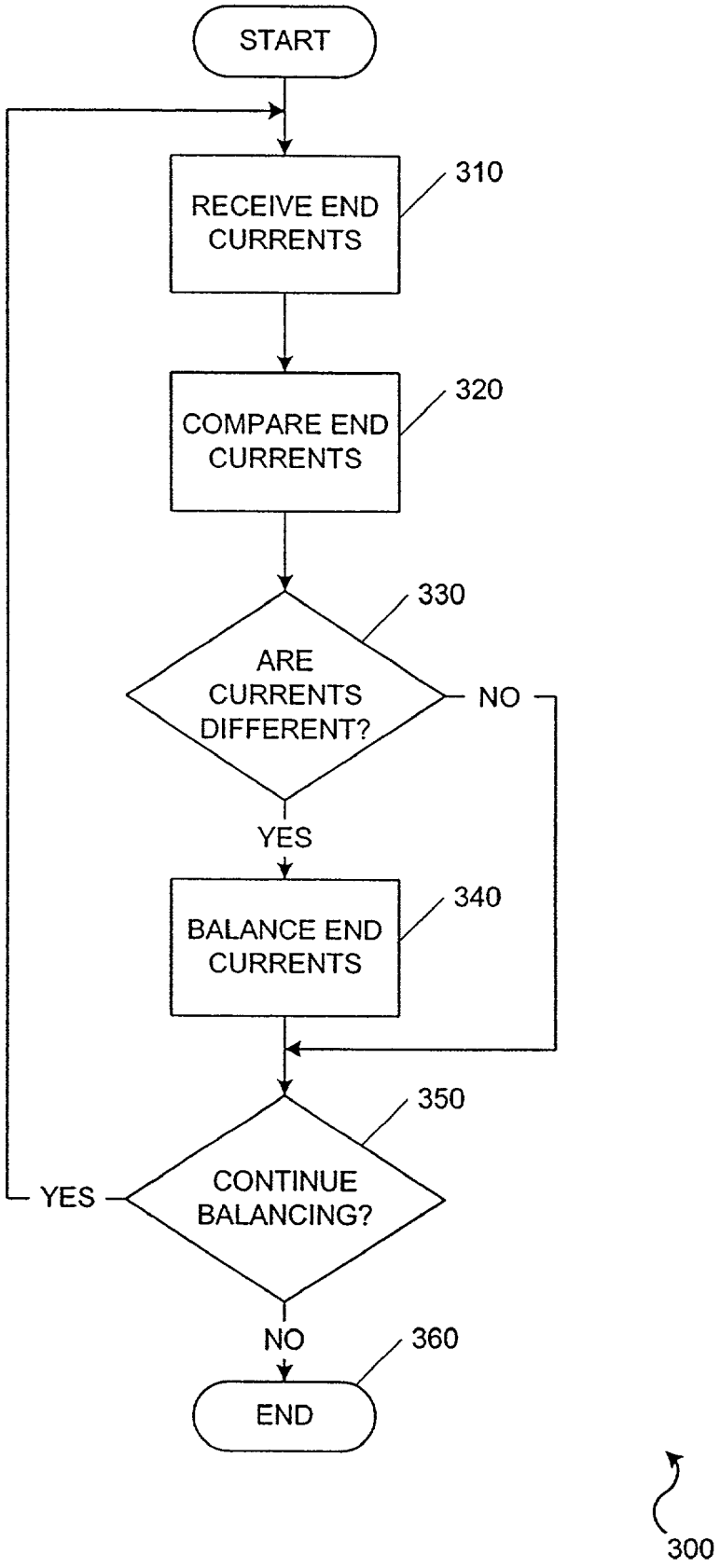
FIG. 3 is a flowchart of a process of balancing currents in accordance with one embodiment of the balancing circuit of FIG. 2.

FIG. 3 is a flowchart of a process 300 of balancing currents in accordance with one embodiment of the balancing circuit 200 of FIG. 2. At block 310, each of the matched transistors 244 and 252 is configured to supply currents to the end regions of the group driver circuit 120. More particularly, the drain terminals 248 and 256 supply currents to the mirror transistors 232 and 236, respectively, and the gate terminals 258 and 250 receive currents from the source transistors 230 and 234, respectively. In a further embodiment, the matched resistors 240 and 242 perform the step of receiving currents from the end regions of the group driver circuit 120. At block 320, the balancing circuit 200 is configured to compare currents received from end regions of the group driver circuit 120. In such an embodiment, the balancing circuit 200 may include a processor (e.g., a programmable processor or an application specific integrated circuit, not shown) that is programmed with instructions to compare currents from said end regions. At decision block 330, the processor of the balancing circuit 200 may determine if the comparison of end region currents produces a difference in said end currents. Whether the end region currents are different is determined by the precision of the current matching that is desired to be achieved in the particular embodiment. If the end region currents are different, the process continues to block 340, described below; otherwise, the process continues directly to block 350, which is also described below.

In the case where the currents in the end regions are of different values, at block 340 the balancing circuit 200 may utilize the processor, or the combination of the matched transistors 244 and 252 and resistors 240 and 242 (as described above), to balance the end currents by compensating for the difference in currents in the end regions. This results in balanced currents at both end regions of the group driver circuit 120. This in turn results in balanced currents flowing through the drain terminals 248 and 256 of the matched transistors 244 and 252 from the current mirror transistors 232, 236. This produces balanced currents flowing through each of the column transistors 214. At block 350, the balancing circuit 200 determines whether to continue balancing end region currents or not. In one embodiment, the balancing circuit 200 may perform the current balancing process at power-up or reset of the display device 100. In another embodiment, the balancing circuit 200 may perform the current balancing process at predetermined time intervals during normal operation of the display device 100. If further current balancing is desired, the process returns to block 310. Otherwise, the balancing process terminates after block 360.

In one embodiment, the current balancing circuit 200 compensates for differences in current sources between the two end columns of the group driver circuit 120, labeled "COL1" 210*a* and "COLN" 210*e* in FIG. 2. In another embodiment, the balancing circuit 200 balances the currents through columns in a region of the end columns 210*a*, 210*e*. The region of the end columns in this embodiment refers to one, two, three, four or five end columns, or a greater number of columns so that the image quality of the display device 100 is improved. In another embodiment, current balancing in the region of the end columns refers to any number of columns in the group driver circuit 120 that results in balanced currents through the end columns 210*a*, 210*e*, or through any desired number of columns. In a further embodiment, current balancing in the region of the end columns refers to any number of columns in the group driver circuit 120 that results in balanced currents through the columns in the vicinity of the end columns 210*a*, 210*e*. It is likely that the further from the end columns the current balancing is performed the greater the corresponding degradation in display quality.

One of ordinary skill in the technology will appreciate that the invention is not limited to the embodiments illustrated by FIGS. 2 and 3, and may be utilized in conjunction with other current balancing embodiments for display driver circuits not here disclosed. In addition, the functionality of the components of the embodiment of FIGS. 2 may be combined into fewer components, different components, or further separated into additional components. The components may additionally be implemented to execute on one or more components. As noted above, the current balancing circuit 200 may utilize a processor or an application specific integrated circuit (ASIC) device. In the case of a current balancing circuit 200 executing on a processor, the processor may be programmed with instructions, for example computer code. In other embodiments, some of the components may be implemented to execute on one or more components external to the group driver circuit 120 or current balancing circuit 200. In a further embodiment, the current sourcing circuit shown in FIG. 2 may be a current sinking circuit, which one of ordinary skill in the technology will appreciate.

Thus, the invention overcomes the longstanding problems in the technology of current imbalance at the end columns of individual column driver circuits in visual display devices by providing a circuit for balancing the currents in the end region columns. A display device incorporating the column driver balancing circuit of the present invention thus has closely matched current through the columns in the end region of each driver circuit. This in turn allows balancing of the currents at the junction of adjacent columns driven by separate driver circuits, thereby eliminating any discernable discontinuity in brightness between areas across the entire display and resulting in a higher quality, more valuable display device.

While the above detailed description has shown, described, and pointed out novel features of the invention as applied to various embodiments, it will be understood that various omissions, substitutions, and changes in the form and details of the device or process illustrated may be made by those of ordinary skill in the technology without departing from the spirit of the invention. The scope of the invention is indicated by the appended claims rather than by the foregoing description. All changes which come within the meaning and range of equivalency of the claims are to be embraced within their scope.

What is claimed is:

1. A method of balancing currents in a display device having at least one display area which includes first and second end regions, the method comprising:

generating a first current from a first driver circuit substantially in the first end region of the display area;

generating a second current from a second driver circuit substantially in the second end region of the display area; and comparing, in a circuit, the first generated current with the second generated current;

and reducing, in the circuit, any difference between the first current and the second current.

2. The method as defined in claim 1, wherein generating the first current comprises generating a current from a first column driver of the display area, and wherein generating the second current comprises generating a current from a second column driver of the display area.

3. The method as defined in claim 1, wherein generating the first current comprises generating a current from a left end column driver of the display area, and wherein generating the second current comprises generating a current from a right end column driver of the display area.

4. The method as defined in claim 3, wherein generating the current from the left end column driver of the display area comprises generating a current using at least a resistor and a transistor, and wherein generating the current from the right end column driver of the display area comprises generating a current using at least a resistor and a transistor.

5. The method as defined in claim 1, wherein generating the first current comprises generating a current from one to five adjacent left end column drivers of the display area, and wherein generating the second current comprises generating a current from one to five adjacent right end column drivers of the display area.

6. The method as defined in claim 1, wherein generating the first and second currents comprises generating currents to drive light-emitting components of the display device.

7. The method as defined in claim 6, wherein generating currents to drive light-emitting components comprises generating currents to drive a plurality of organic light-emitting diodes.

8. A method of manufacturing a circuit for balancing currents in a display device having at least one display area which includes first and second end regions, the method comprising the steps of:

assembling a first driver circuit, the first driver circuit being configured to generate a first current substantially in the first end region of the display area;

assembling a second driver circuit, the second driver circuit being configured to generate a second current substantially in the second end region of the display area; and electrically connecting a balancing circuit to the first and second driver circuits, the balancing circuit being configured to compare the first current with the second current and reduce any difference between the first current and the second current.

9. The method as defined in claim 8, wherein the first driver circuit comprises a first column driver of the display area, and the second driver circuit comprises a second column driver of the display area.

10. The method as defined in claim 8, wherein the first driver circuit comprises a left end column driver of the display area, and the second driver circuit comprises a right end column driver of the display area.

11. The method as defined in claim 8, wherein the first driver circuit comprises from one to five adjacent left end column drivers of the display area, and the second driver circuit comprises from one to five adjacent right end column drivers of the display area.

12. The method as defined in claim 8, wherein the first and second driver circuits are configured to drive light-emitting components of the display device.

* * * * *